US006073820A

United States Patent [19]

Drobinski

[11] Patent Number: 6,073,820

[45] Date of Patent: Jun. 13, 2000

[54] COLLAPSIBLE CHILD CARRIER ASSEMBLY

[75] Inventor: Jerome J. Drobinski, Reading, Pa.

[73] Assignee: Infantino, A Dorel Co., San Diego, Calif.

[21] Appl. No.: 09/309,447

[22] Filed: May 11, 1999

[51] Int. Cl.[7] ..... A61G 1/013

[52] U.S. Cl. ..... 224/161; 224/155; 224/158; 224/159; 224/160; 224/627; 224/628; 224/634

[58] Field of Search ..... 224/161, 158, 224/159, 160, 155, 634, 633, 627, 628; 297/118, 129, 130

[56] References Cited

U.S. PATENT DOCUMENTS

| | | | |
|---|---|---|---|
| 3,989,173 | 11/1976 | Gebhard | 224/161 |
| 4,044,931 | 8/1977 | Catelli | 224/161 |
| 4,762,256 | 8/1988 | Whitaker | 224/161 |
| 4,938,400 | 7/1990 | Springston . | |
| 5,020,709 | 6/1991 | Hoaglan | 224/151 |
| 5,046,651 | 9/1991 | Dagdagan . | |
| 5,609,279 | 3/1997 | O'Shea . | |
| 5,649,658 | 7/1997 | Hoffman et al. . | |
| 5,662,339 | 9/1997 | Svendsen et al. . | |
| 5,676,287 | 10/1997 | Huang . | |
| 5,704,523 | 1/1998 | Wang | 224/161 |

*Primary Examiner*—Gregory M. Vidovich
*Assistant Examiner*—Maerena W. Brevard
*Attorney, Agent, or Firm*—Stetina Brunda Garred & Brucker

[57] ABSTRACT

A collapsible child carrier assembly having a support frame which comprises a pair of hinge members, each of which includes a bore extending therein. The support frame further includes front and back support structures, each of which are attached to the hinge members. Also included in the support frame is a top support bar having opposed ends and a pair of elongate slots extending longitudinally therein adjacent respective ones of the opposed ends thereof. The top support bar is pivotally connected to the hinge members via a pair of pivot pins which extend through and are movable within respective ones of the slots. The top support bar is movable between a locked position whereat the opposed ends thereof are inserted into respective ones of the bores so as to maintain the top support bar in fixed relation to the front support structure, and an unlocked position whereat the opposed ends thereof are removed from within the bores so as to allow the top support bar to be pivotally movable relative to the front support structure about the pivot pins. The movement of the top support bar between the locked and unlocked positions is facilitated by the movement of the pivot pins within respective ones of the slots.

7 Claims, 2 Drawing Sheets

COLLAPSIBLE CHILD CARRIER ASSEMBLY

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to backpacks, and more particularly to a collapsible child carrier assembly for use in carrying a child or infant on the back of an adult and including a collapsible support frame which, when actuated or folded to its collapsed state, causes the carrier assembly to assume an extremely small profile which enhances its portability and ease of storage.

There is currently known in the prior art a wide variety of backpack-type child carriers which are used to allow an infant or small child to be carried upon the chest or back of an adult. Some of these prior art child carriers include a frame structure which may be reconfigured from a child backpack to a child seat which may be rested upon a generally flat surface (e.g., U.S. Pat. Nos. 5,609,279 and 5,676,287) or to a high chair which may be mounted to a table (e.g., U.S. Pat. No. 4,938,400). Other prior art child carriers include a frame structure which is selectively convertible from a child backpack to either a child seat which is adapted to be rested upon a flat surface or a high chair which is adapted to be mounted to a table (e.g., U.S. Pat. No. 5,046,651). Additionally, there is at least one prior art child carrier wherein the frame structure thereof is adapted to be reconfigured from a child backpack into a stroller (e.g., U.S. Pat. No. 5,662,339).

Though each of the above-described child carriers includes a collapsible frame structure which may be selectively reconfigured to accomplish more than one function, the configuration of such frame structures and the number and size of the components included therein does not allow for the collapse of the child carrier into an extremely small profile as is best suited for portability and ease of storage. Though U.S. Pat. No. 5,676,287 (the "'287 patent") discloses a frame structure which may be collapsed to a relatively small profile, such frame structure possesses certain deficiencies which detract from its overall utility.

More particularly, the upper support assembly of the frame structure described in the '287 patent is susceptible to an accidental collapse due to the manner in which it is integrated into the frame structure and normally maintained in its extended, uncollapsed state. In this respect, the upper support assembly is maintained in its extended state by a biasing force normally exerted by a retention mechanism associated therewith. However, this biasing force may be easily overcome by applying only a modest amount of pulling force to the upper support assembly, thus disengaging the retention mechanism and resulting in the collapse of the upper support assembly. The present invention overcomes the deficiencies of the prior art child carriers, and in particular the child carrier described in the '287 patent, by providing a collapsible child carrier assembly which may be used in carrying a small child or infant on the back of an adult, and includes a support frame which may be selectively reconfigured to allow the carrier assembly to be used as a child seat by resting the same upon a generally flat or planar support surface. The present carrier assembly is collapsible to an extremely small profile, yet includes a hinge mechanism which is specifically configured to substantially reduce the susceptibility of the top support bar of the support frame to an accidental collapse.

BRIEF SUMMARY OF THE INVENTION

In accordance with the present invention, there is provided a collapsible child carrier assembly which comprises a support frame having a flexible sling attached thereto for carrying a small child or infant. The sling itself includes a pouch portion which accommodates the child and a pair of adjustable shoulder strap portions for allowing the carrier assembly to be maintained upon the back of an adult.

The support frame of the present carrier assembly comprises a pair of identically configured hinge members, each of which includes a circularly configured bore extending therein. Attached to the hinge members is a front support structure. The front support structure preferably comprises a pair of identically configured front support bars having bottom ends and top ends which are rigidly attached to respective ones of he hinge members. In addition to the front support bars, the front support structure comprises a strut which is attached to and extends laterally between (i.e., interconnects) the front support bars. The strut is preferably attached to the front support bars such that the opposed ends thereof are disposed in close proximity to respective ones of the bottom ends of the front support bars. The strut is adapted to rest on the adult's lower back to provide support to the carrier assembly when the same is being used in a backpack-like fashion.

In addition to the front support structure, the support frame includes a back support structure which is attached to the hinge members. The back support structure preferably comprises a generally U-shaped back support bar having an elongate base portion and opposed ends which are pivotally connected to respective ones of the hinge members. In this respect, the back support bar is pivotally movable between an extended position whereat the base portion is disposed in spaced relation to the front support structure, and in particular the front support bars thereof, and a collapsed position whereat the base portion is disposed adjacent the front support structure. In the preferred embodiment, the support frame is configured such that the bottom ends of the front support bars of the front support structure and the base portion of the back support bar of the back support structure are generally co-planar when the back support bar is in its extended position, thus allowing the carrier assembly to be rested upon a generally planar surface and used as a stationary seat for the child.

The support frame of the present carrier assembly further comprises a top support bar having opposed ends and a pair of elongate slots extending longitudinally therein adjacent respective ones of the opposed ends thereof. The top support bar is pivotally connected to the hinge members via a pair of pivot pins which extend through and are movable within respective ones of the slots. In the present carrier assembly, the top support bar is selectively movable between locked and unlocked positions. In the locked position, the opposed ends of the top support bar are inserted into and thus reside within respective ones of the bores so as to maintain the top support bar in fixed relation to the front support structure. In the unlocked position, the opposed ends of the top support bar are removed from within and thus disposed outside of the bores so as to allow the top support bar to be selectively pivoted toward or away from the front support structure via the rotation thereof about the pivot pins. Importantly, the movement of the top support bar between its locked and unlocked positions is facilitated by the longitudinal travel of the pivot pins within respective ones of the slots.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENT

Figure 1:
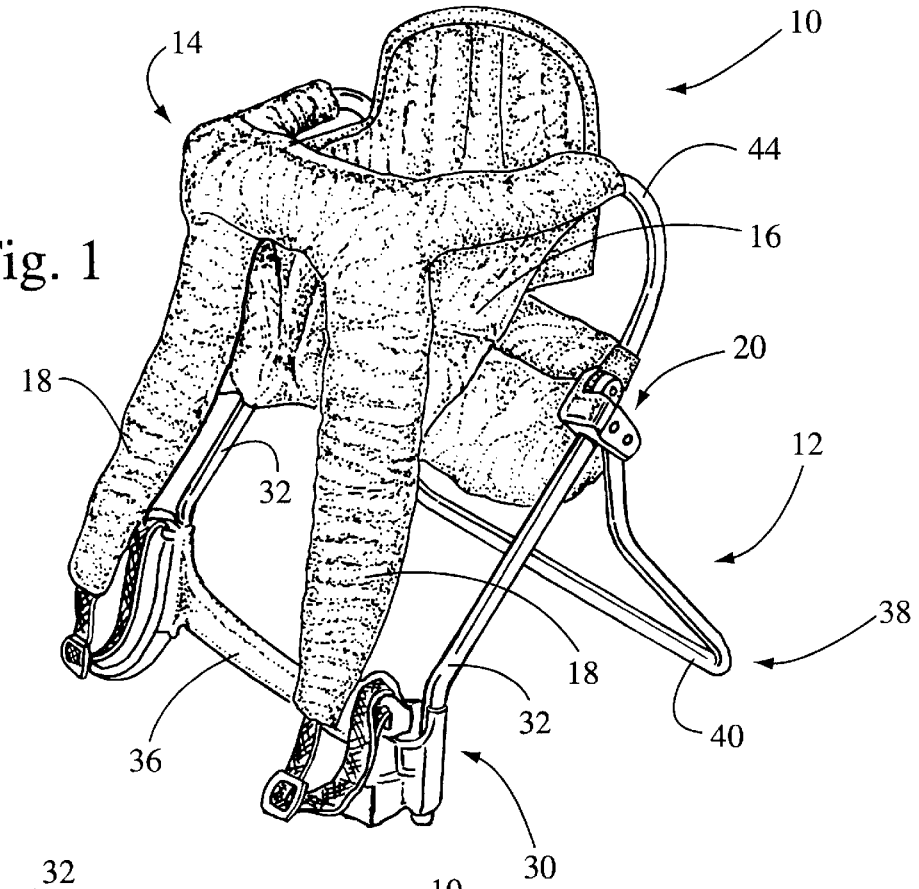
FIG. 1 is a front, perspective view of the collapsible child carrier assembly of the present invention in its operative, fully uncollapsed state.

Referring now to the drawings wherein the showings are for purposes of illustrating a preferred embodiment of the present invention only, and not for purposes of limiting the same, FIG. 1 perspectively illustrates the collapsible child carrier assembly 10 constructed in accordance with the present invention in its operative, fully uncollapsed state. As will be discussed in more detail below, when the carrier assembly 10 is in its uncollapsed state as shown in FIG. 1, the same may either be carried or maintained upon the back of an adult, or alternatively placed upon a flat or generally planar support surface to serve as a stand alone child seat. In the preferred embodiment, the carrier assembly 10 comprises a support frame 12 which has a flexible sling 14 attached thereto. The sling 14 is typically fabricated from a soft, cloth material, and is configured to carry a small child or infant. In this respect, the sling 14 is formed to include a pouch portion 16 which accommodates the child, and a pair of adjustable shoulder strap portions 18 for allowing the carrier assembly 10 to be maintained upon the back of an adult.

In the present carrier assembly 10, the support frame 12 comprises a pair of identically configured hinge members 20, each of which includes a body portion 22 having an opposed pair of ear portions 24 extending from one end thereof in spaced relation to each other. Each of the hinge members 20 further comprises a generally U-shaped channel portion 26 which is integrally connected to the outside surface of the body portion 22 such that the ear portions 24 extend generally perpendicularly relative to the base of the channel portion 26. As such, the ear portions 24 and opposed legs or flanges of the channel portion 26 extend in generally opposite directions. Each hinge member 20 is configured such that the body portion 22 is offset toward one end of the channel portion 26 rather than being centrally positioned between the opposed ends thereof. Disposed within the body portion 22 of each hinge member 20 between the ear portions 24 thereof is a circularly configured bore 28. The bore 28 is preferably sized so as to terminate within the body portion 22, although those of ordinary skill in the art will recognize that the bore 28 may extend longitudinally all the way through the body portion 22.

Figure 2:
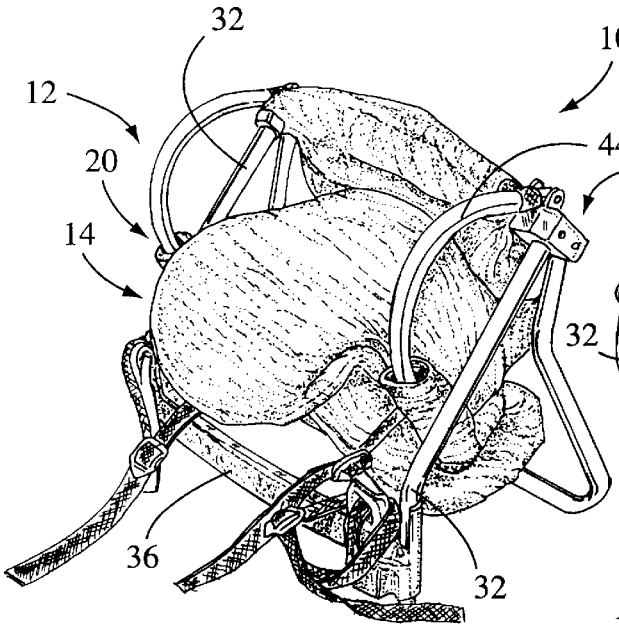
FIG. 2 is a front perspective view of the present child carrier assembly in a partially collapsed state.
Figure 3:
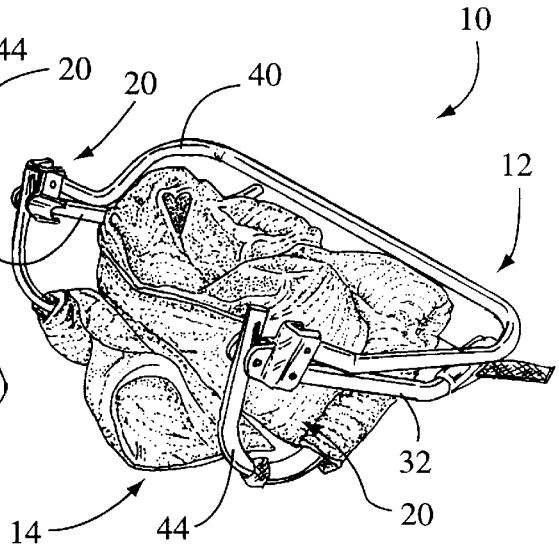
FIG. 3 is a front perspective view of the present child carrier assembly in a fully collapsed state.
Figure 5:
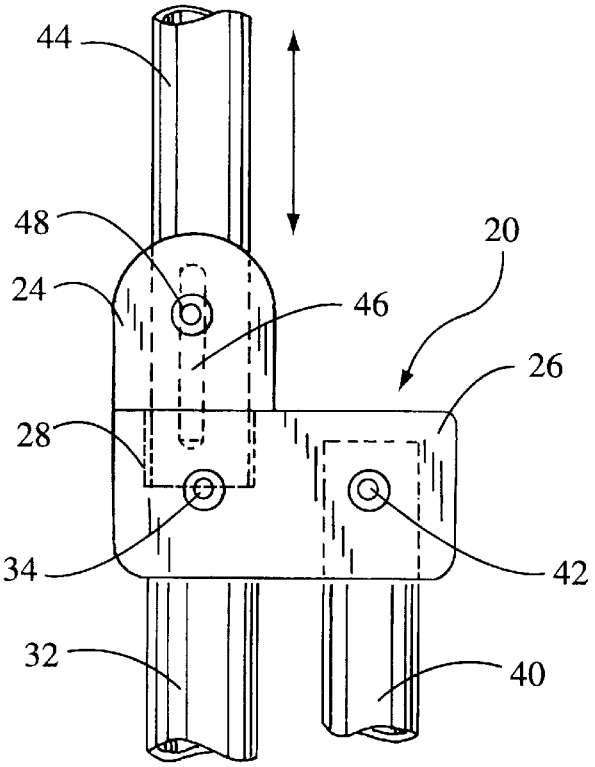
FIG. 5 is a side elevational view illustrating the orientation of the top support bar relative to the hinge members in the present child carrier assembly when the top support bar is in its locked position.

Referring now to FIGS. 1–3, the support frame 12 further comprises a front support structure 30 which is attached to the hinge members 20. The front support structure 30 preferably comprises a pair of identically configured, tubular front support bars 32 which are fabricated from a rigid material such as metal. The front support bars 32 each define a bottom end and a top end which is rigidly attached to a respective one of the hinge members 20. In particular, the top end of each front support bar 32 is inserted into the interior of the channel portion 26 of a respective hinge member 20 (i.e., between the legs or flanges of the channel portion 26) and rigidly secured therewithin via a fastener 34 such as a rivet. As best seen in FIG. 5, when rigidly attached to a respective hinge member 20, each front support bar 32 extends generally perpendicularly from that end of the base of the channel portion 26 which is disposed closest to the ear portions 24.

In addition to the front support bars 32, the front support structure 30 comprises an elongate strut 36 which is attached to and extends laterally between (i.e., interconnects) the front support bars 32. The strut 36 is preferably fabricated from a plastic material, and is attached to the front support bars 32 such that the opposed ends thereof are disposed in close proximity to respective ones of the bottom ends of the front support bars 32. The strut 36 is configured to rest upon the adult's lower back to support the carrier assembly 10 when the same is being used in a backpack-like fashion by the extension of the shoulder strap portions 18 of the sling 14 about the shoulders of the adult.

Figure 4:
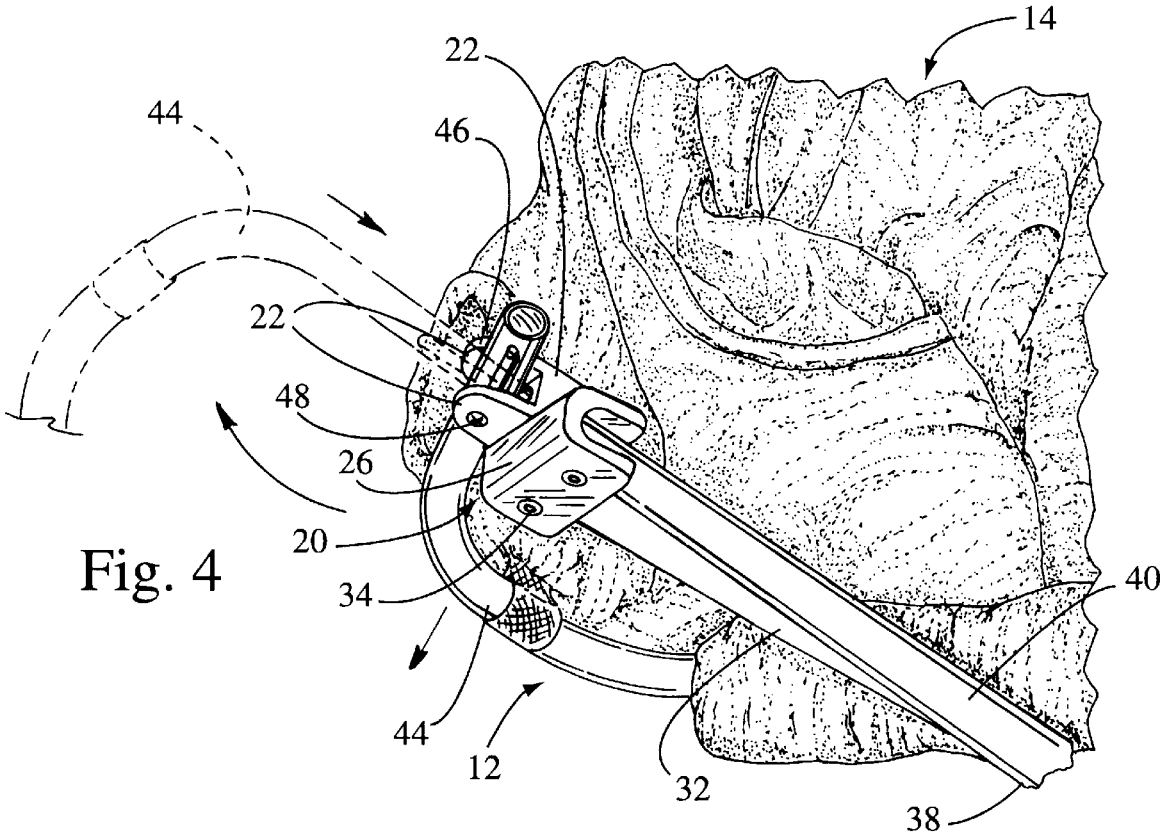
FIG. 4 is a partial perspective view illustrating the manner in which the top support bar of the present child carrier assembly is moved between its locked and unlocked positions relative to the hinge members thereof.

In addition to the front support structure 30, the support frame 12 includes a back support structure 38 which is also attached to the hinge members 20. The back support structure 38 is preferably fabricated from a rigid material such as metal, and comprises a tubular, generally U-shaped back support bar 40 having an elongate base portion and opposed ends which are pivotally connected to respective ones of the hinge members 20. More particularly, as seen in FIGS. 4 and 5, each end of the back support bar 40 is inserted into the interior of the channel portion 26 of a respective hinge member 20 (i.e., between the legs or flanges of the channel portion 26) and pivotally connected thereto via a fastener 42 such as a pivot pin. As such, each end of the back support bar 40 is pivotally connected to a respective hinge member 20 in close proximity to that end of the channel portion 26 thereof disposed furthest from the ear portions 24.

Due to its pivotal connection to the hinge members 20 via the fasteners 42, the back support bar 40 is pivotally moveable between an extended position (shown in FIGS. 1 and 2) whereat the base portion thereof is disposed in spaced relation to the front support structure 30, and in particular the front support bars 32 thereof, and a collapsed position (shown in FIGS. 3–5) whereat the base portion is disposed adjacent the front support structure 30. In the preferred embodiment, the support frame 12 is configured such that the bottom ends of the front support bars 32 of the front support structure 30 and the base portion of the back support bar 40 of the back support structure 38 are generally co-planar when the back support bar 40 is in its extended position, thus allowing the carrier assembly 10 to be rested upon a generally planar surface and used as a stationary seat for the child in the manner shown in FIG. 1.

The support frame 12 of the carrier assembly 10 further comprises a tubular top support bar 44 having opposed ends and a pair of elongate slots which extend longitudinally therein adjacent respective ones of the opposed ends thereof. The top support bar 44 is also preferably fabricated from a rigid material such as metal. In the carrier assembly 10, the top support bar 44 is pivotally connected to the hinge members 20 via a pair of pivot pins 48 which extend through and are moveable within respective ones of the slots 46. More particularly, the slots 46 of the top support bar 44 are positioned between respective pairs of the ear portions 24, with each of the pivot pins 48 being advanced through a respective slot 46 and attached to each of the ear portions 24 of the corresponding pair. Since the widths of the slots 46 exceed the diameters of the pivot pins 48, the top support bar 44 is movable relative to the hinge members 28 via the longitudinal travel of the pivot pins 48 within the slots 46.

In the present carrier assembly 10, the top support bar is selectively movable between a locked position (shown in FIGS. 1 and 5 and in phantom in FIG. 4) and an unlocked position (shown in FIGS. 2–4). In the locked position, the opposed ends of the top support bar 44 are inserted into and thus reside within respective ones of the bores 28 within the body portions 22 of the hinge members 20 so as to maintain the top support bar 44 in fixed relation to the front support structure 30. In the unlocked position, the opposed ends of the top support bar 44 are removed from within and thus disposed outside of the bores 28 so as to allow the top support bar 44 to be selectively pivoted toward or away from the front support structure 30 via the rotation thereof about the pivot pins 48.

As best seen in FIGS. 4 and 5, the movement of the top support bar 44 between its locked and unlocked positions is facilitated by the longitudinal movement or travel of the pivot pins 48 within the slots 46. More particularly, the movement of the top support bar from its locked position to its unlocked position is facilitated by pulling the top support bar 44 in a direction outwardly away from the hinge members 20 which results in the removal of the ends of the top support bar 44 from within the bores 28. As will be recognized, this outward movement of the top support bar 44 results in the orientations of the pivot pins 48 relative thereto being shifted from the ends of the slots 46 disposed furthest from the ends of the top support bar 44 to those ends of the slots 46 which are disposed closest to the ends of the top support bar 44. The removal of the ends of the top support bar 44 from within the bores 28 allows the top support bar 44 to be pivoted or rotated about the pivot pins 48. Conversely, the movement of the top support bar 44 from its unlocked position to its locked position is facilitated by first rotating the top support bar 44 such that the ends thereof are coaxially aligned with respective ones of the bores 28. Thereafter, the top support bar 44 is moved inwardly toward the hinge members 20 so as to facilitate the insertion of the ends of the top support bar 44 into the bores 28. As will also be recognized, such inward movement of the top support bar 44 relative to the hinge members 20 results in the orientations of the pivot pins 42 relative to the top support bar 44 being shifted from those ends of the slots 46 disposed closest to the ends of the top support bar 44 to those ends of the slots 46 disposed furthest therefrom. Once the top support bar 44 has been moved to its locked position, any rotation thereof relative to the hinge members 20 and hence the front support structure 30 is prevented by the receipt of the ends of the top support bar 44 into the bores 28.

Having thus described the structural attributes of the carrier assembly 10 of the present invention, the preferred method of using the same will now be described with particular reference to FIGS. 1–5. As indicated above, when the carrier assembly 10 is in its operative, fully uncollapsed state as shown in FIG. 1, the same may be used in a backpack-like fashion by extending the shoulder strap portions 18 of the sling 14 over an adult's shoulders such that the strut 36 rests firmly against the adult's lower back. Alternatively, the carrier assembly 10 may be used as a child seat by resting the bottom ends of the front support bars 32 and base portion of the back support bar 40 upon a generally flat surface. The movement of the carrier assembly 10 from is uncollapsed state to its collapsed state is preferably facilitated by first moving the top support bar 44 from its locked position to its unlocked position in the above-described manner. Thereafter, the top support bar 44 is pivoted forwardly toward the front support structure 30, and in particular the front support bars 32 thereof in the manner shown in FIG. 2. Thereafter, the back support bar 40 is pivoted from its extended position shown in FIGS. 1 and 2 to its retracted position shown in FIGS. 3 and 5 such that it extends in generally side-by-side relation to the front support structure 30.

The movement of the carrier assembly 10 from its fully collapsed state shown in FIG. 3 to its fully uncollapsed state shown in FIG. 1 is accomplished in the reverse sequence. In this respect, subsequent to the pivotal movement of the back support bar 40 from its retracted position to its extended position, the top support bar 44 is pivoted about the pivot pins 48 away from the front support structure 30. After the ends of the top support bar 44 have been brought into coaxial alignment with the bores 28 of the hinge members 20, the top support bar 44 is moved from its unlocked position to its locked position in the above-described manner, thus making the carrier assembly 10 ready for use as either a backpack or child seat as indicated above. As will be recognized, the flexible nature of the material preferably used to form the sling 14 allows the same to collapse concurrently with the collapse of the support frame 12.

As is evident from FIG. 3 of the present application, the present carrier assembly 10 is collapsible to an extremely small profile which enhances its portability and ease of storage. The ability of the support frame to be collapsed to such a small profile is due, in part, to the inclusion of a relatively small number of components therein. Though the carrier assembly 10 is adapted to assume an extremely compact configuration when fully collapsed, the configuration of the hinge members 20 thereof substantially reduces the susceptibility of the top support bar 44 of the support frame 12 to an accidental collapse. In this respect, the movement of the child or infant within the sling 14 will typically not result in the removal of the ends of the top support bar 44 from within the bores 28 as is required to facilitate the movement of the top support bar 44 to its unlocked position.

Additional modifications and improvements of the present invention may also be apparent to those of ordinary skill in the art. Thus, the particular combination of parts described and illustrated herein is intended to represent only one embodiment of the present invention, and is not intended to serve as limitations of alternative devices within the spirit and scope of the invention.

What is claimed is:

1. A collapsible child carrier assembly, comprising:

a support frame comprising:

a pair of hinge members, each of the hinge members having a bore extending therein;

a front support structure attached to the hinge members;

a back support structure attached to the hinge members; and a top support bar having opposed ends and a pair of elongate slots extending longitudinally therein adjacent respective ones of the opposed ends thereof, the top support bar being pivotally connected to the hinge members via a pair of pivot pins which extend through and are movable within respective ones of the slots;

the top support bar being movable between a locked position whereat the opposed ends thereof are inserted into respective ones of the bores so as to maintain the top support bar in fixed relation to the front support structure, and an unlocked position whereat the opposed ends thereof are removed from within the bores so as to allow the top support bar to be pivotally movable relative to the front support structure about the pivot pins, the movement of the top support bar between the locked and unlocked positions being facilitated by the movement of the pivot pins within respective ones of the slots.

2. The carrier assembly of claim 1 wherein the front support structure comprises a pair of front support bars having bottom ends and top ends which are rigidly attached to respective ones of the hinge members.

3. The carrier assembly of claim 2 wherein the front support structure further comprises a strut attached to and extending between the front support bars.

4. The carrier assembly of claim 2 wherein the back support structure comprises:

a generally U-shaped back support bar having an elongate base portion and opposed ends which are pivotally connected to respective ones of the hinge members;

the back support bar being pivotally movable between an extended position whereat the base portion is disposed in spaced relation to the front support bars and a collapsed position whereat the base portion is disposed adjacent the front support bars.

5. The carrier assembly of claim 4 wherein the support frame is configured such that the bottom ends of the front support bars and the base portion of the back support bar are generally co-planar when the back support bar is in the extended position.

6. The carrier assembly of claim 1 further comprising a flexible sling attached to the support frame for carrying a child.

7. The carrier assembly of claim 6 wherein the sling includes a pouch portion for accommodating the child and a pair of shoulder strap portions for allowing the carrier assembly to be maintained upon an adult's back.

* * * * *